US010947722B2

(12) United States Patent
Baltz, Jr. et al.

(10) Patent No.: US 10,947,722 B2
(45) **Date of Patent: *Mar. 16, 2021**

(54) BELOW TOP OF WALL VENTILATION SCREED DEVICE AND ASSEMBLY

(71) Applicant: Alabama metal industries corporation, Birmingham, AL (US)

(72) Inventors: Gary George Baltz, Jr., Mountain Brook, AL (US); Frederic C. Mayer, Jr., Hoover, AL (US)

(73) Assignee: ALABAMA METAL INDUSTRIES CORPORATION

( * ) Notice: Subject to any disclaimer, the term of this patent is extended or adjusted under 35 U.S.C. 154(b) by 0 days.

This patent is subject to a terminal disclaimer.

(21) Appl. No.: 16/916,185

(22) Filed: Jun. 30, 2020

(65) Prior Publication Data

US 2020/0332517 A1 Oct. 22, 2020

Related U.S. Application Data

(63) Continuation of application No. 16/706,904, filed on Dec. 9, 2019, now Pat. No. 10,753,083, which is a (Continued)

(51) Int. Cl.
*E04B 1/70* (2006.01)
*E04F 19/02* (2006.01)
(Continued)

(52) U.S. Cl.
CPC ..... *E04B 1/7069* (2013.01); *E04B 1/7038* (2013.01); *E04D 13/152* (2013.01); *E04F 13/007* (2013.01); *E04F 19/02* (2013.01)

(58) Field of Classification Search
CPC ..... E04F 13/007; E04F 19/02; E04F 19/04; E04F 2019/0445; E04B 1/7069; E04B 1/7038; E04D 13/152
See application file for complete search history.

(56) References Cited

U.S. PATENT DOCUMENTS 2,664,057 A * 12/1953 Ausland ..... E04D 13/1415 52/61
3,486,283 A * 12/1969 Arnett ..... E04D 13/152 52/255

(Continued)

FOREIGN PATENT DOCUMENTS

DE 3603272 A1 * 8/1987 ..... E04F 19/061
GB 2124266 A * 2/1984 ..... E04D 13/152

(Continued)

*Primary Examiner* — Adriana Figueroa
(74) *Attorney, Agent, or Firm* — Jennifer Meredith, Esq.; Lippes Mathias Wexler Friedman LLP

(57) ABSTRACT

A ventilation screed with an upper attachment flange having a top portion and a bottom portion and at least one opening in the top portion; a drip edge protruding from the bottom portion and a return leg that protrudes back from the drip edge and extends beyond the bottom portion; a drainage cavity protrusion protruding from the bottom portion above the drip edge, wherein the drainage cavity protrusion has an L-shaped drainage trough portion having at least one drainage opening in a bottom portion and a substantially vertical portion with a top end and a bottom end in communication with the bottom portion, an upper ground portion in communication with the top end of the substantially vertical portion of the L-shaped drainage trough portion extending outward from the substantially vertical portion and a drainage cavity shroud extending substantially downward from the upper ground portion.

17 Claims, 15 Drawing Sheets

Related U.S. Application Data continuation-in-part of application No. 16/194,775, filed on Nov. 19, 2018, now Pat. No. 10,533,324.

(51) Int. Cl.
*E04D 13/152* (2006.01)
*E04F 13/00* (2006.01)

(56) References Cited

U.S. PATENT DOCUMENTS 5,003,743 A * 4/1991 Bifano ..... E04F 13/06 52/288.1
5,970,671 A * 10/1999 Bifano ..... E04B 1/765 428/603
6,298,609 B1 * 10/2001 Bifano ..... E04B 1/765 52/101
6,505,448 B2 * 1/2003 Ito ..... E04F 13/0803 52/302.1
6,679,010 B2 * 1/2004 Honda ..... E04D 13/152 52/95
7,383,669 B2 * 6/2008 Morse ..... E04F 13/0864 52/459
9,366,040 B2 * 6/2016 Singh ..... E04B 1/64
10,024,063 B2 * 7/2018 Friel ..... E04F 13/06
10,196,812 B1 * 2/2019 Duffy ..... E04F 13/06
2008/0104918 A1 * 5/2008 Gleeson ..... E04B 1/762 52/489.1
2009/0183453 A1 * 7/2009 Koessler ..... E04F 17/04 52/302.3

FOREIGN PATENT DOCUMENTS

GB 2169071 A * 7/1986 ..... E04B 1/74
GB 2171124 A * 8/1986 ..... E04D 13/064

* cited by examiner

FIGURE 14
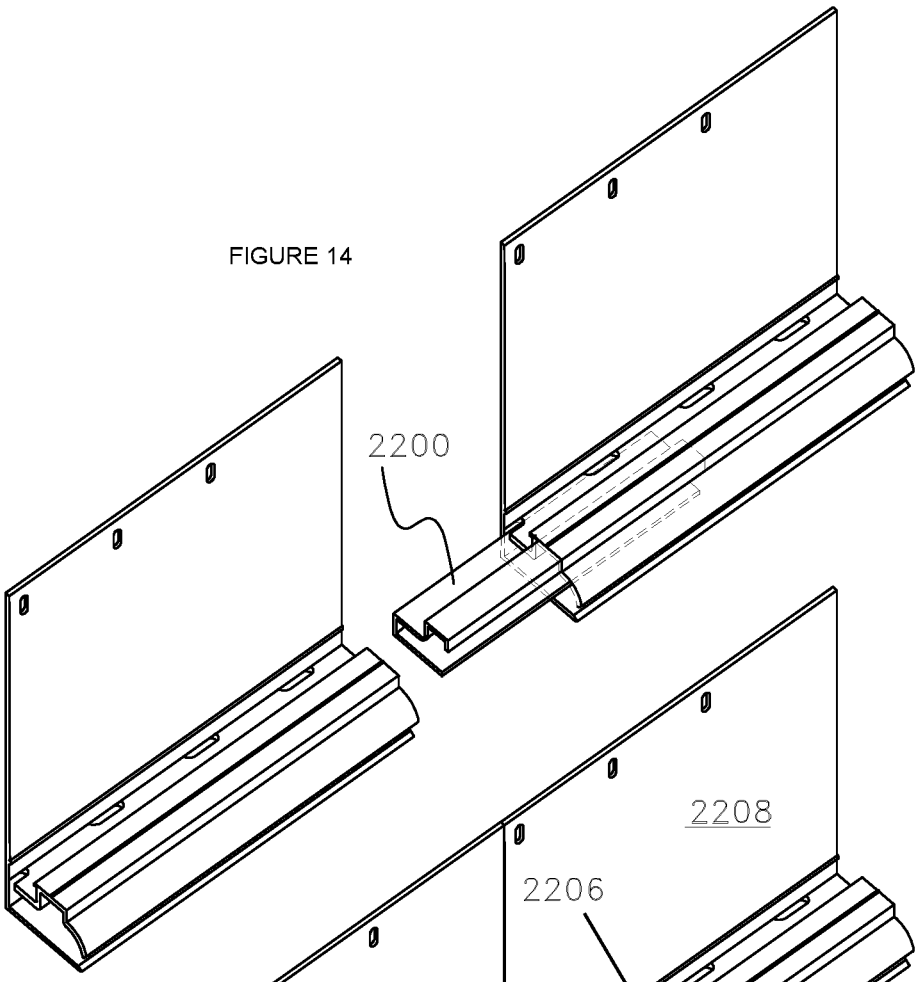
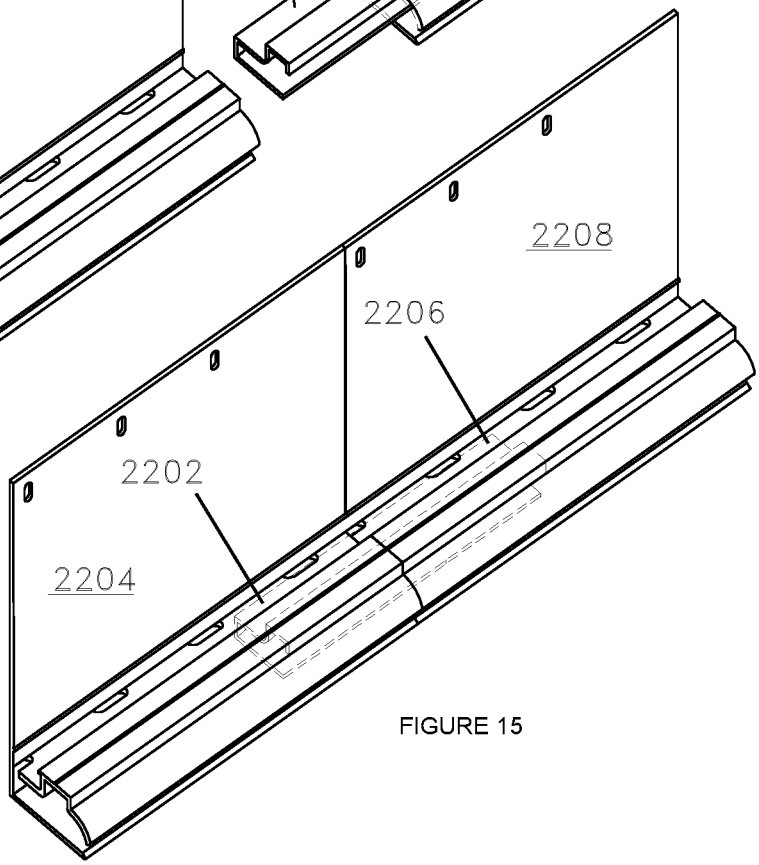
FIGURE 15

BELOW TOP OF WALL VENTILATION SCREED DEVICE AND ASSEMBLY

This application is a continuation-in-part of application Ser. No. 16/194,775 filed Nov. 19, 2018 entitled "BELOW TOP OF WALL VENTILATION SCREED DEVICE AND ASSEMBLY" and incorporated herein by reference.

TECHNICAL FIELD

The present disclosure generally relates to a device configured to allow ventilation and the escape of water or other moisture in the form of vapor at locations below the top of a building or structure wall. Such conditions typically occur but are not limited to, locations above windows and doors and the juncture of dissimilar construction materials, and the bases of walls or transitions from floor to floor on multistory buildings.

BACKGROUND

For purposes of the foregoing specification and appended claims the term "vapor," whether or not accompanied by any words such as "moisture," "water" or other words describing similar matter or states of matter, refers to all forms of liquid and gases not limited to water, water vapor, moisture as created by any means.

This invention addresses the condition that walls hold vapor and moisture and their inability to allow vapor and moisture to escape so the wall can dry is a major factor in the premature deterioration of a structure. Building science, construction practices and emerging energy codes have changed greatly over recent decades resulting in significantly better insulated walls. Consequently these newer wall designs allow less means for vapor and moisture to escape and less air flow. This has led to increasingly premature deterioration of walls of buildings and structures.

Established wall designs and construction are intended to keep water out of walls but not necessarily to allow them to breathe. Building wraps traditionally prevent water intrusion but do not let moisture out. A better wall design must allow for moisture and vapor to move through a predetermined path depending upon when the inside and outside temperatures have the sufficient temperature difference to create and hold excess moisture.

Further, air pressure differential from inside and outside the wall due to temperature and or wind can force moisture into the wall through the wall's surface, in addition to preventing vapor and moisture from escaping. This prevents condensation from escaping and inhibits drying. Further, when cold air contacts hot air, or vice versa, condensation occurs and moisture is formed inside the walls of buildings and structures.

As a result, moisture and water accumulates without a means to escape causing the sheathing of walls to absorb moisture. Plywood, cement board, or OSB (Oriented Strand Board), which is more prone to absorb moisture, can begin to mold, deteriorate, rot and hold more water. As the sheathing fails the weight of the finish material will begin to crack. This allows more moisture accumulation in the walls. Ultimately the finish material can fall away from the building or structure. Areas receiving 20-inches or more of rain a year are the most susceptible to this type of deterioration.

Current building science, and construction materials and practices do not provide a clear and effective means for vapor to escape from different conditions within the walls of a building or structure. "J" bead and casing beads have been used at the base of walls as a possible means for vapor to escape. A misconception is that punched drainage holes in the ground allow moisture to escape. During installation of a stucco finish these holes become blocked and the only escape for vapor is through the stucco membrane or other cladding material which promotes accelerated deterioration. This method only works in areas where no or negligible rainfall is present.

Weep screeds have been used with stucco cladding and currently are the only the vapor escape method approved by building codes and standards. Again, the weep screed is ineffective because the path for vapor to escape a weep screed is the minute space created between the finish and the upper surface of the screed as the finish cures and shrinks.

Another problem area occurs at through wall penetrations such as above windows and doors. Casing beads with drip holes as disclosed above do not provide a reliable vehicle for vapor or water escape. Further, casing beads plus a drip edges create additional problems in their attempt at solving the vapor and water intrusion/vapor escape problems. The cutting trimming of drip edges to block the assembly from water intrusion is as much a problem as providing an escape for vapor.

U.S. Pat. No. 8,584,416 is a movement control screed which provides for the movement of adjacent upper and lower masonry coatings, allowing for some drainage of water only from the upper stucco panel. The patent teaches that the device is intended to keep water out by providing for movement at the floor plates. It does not teach or claim to allow the escape of vapor or for the wall to dry. There is no provision for incorporating a defined drainage plane, that is rainscreen. Further, this device was intended for wood framed and sheathed construction with a stucco finish above and stucco over masonry or block below. The patent does not cover a three coat stucco finish above and below or stucco above and stone below.

U.S. Pat. No. 7,673,421 is a device to allow for water drainage only at floor joints. The patent teaches that the device is intended to keep water out by providing for movement at the floor plates and not to allow for vapor to escape or for the wall to dry. There is no provision for incorporating a defined drainage plane, that is a rainscreen. Further, this device was intended for wood framed and sheathed construction with a stucco finish above and stucco over masonry or block below. The patent does not cover a three coat stucco finish above and below or stucco above and stone below.

U.S. Pat. No. 7,634,883 is a device intended to move exterior water in the form of rain or condensation and drip away from the structure. The patent does not teach or claim the escape of vapor from inside the wall or for the wall to dry, nor is there any allowance for incorporating a defined drainage plane, that is a rainscreen. Further, this device is limited to wood framed and sheathed construction with a stucco finish above and stucco over masonry or block below. The patent does not cover a three coat stucco finish above and below or stucco above and stone below.

Designs currently available only use casing beads, "J' beads, weep screeds and screeds for the mid wall juncture of finish at a floor line or dissimilar materials of a structure or a building. The current art does not facilitate the ventilation of a primary drainage cavity or the drying of the inside of the wall. Some of these areas of concern are at the base of full height walls and step walls, changes in roofline where a vertical element terminates into a non-vertical structure such as a dormer and roof for the removal of vapor from the wall. In areas as noted above where greater rainfall is typical a more defined escape means for vapor and moisture is required over current methods.

Current commercially available accessories for stucco, stone and other finishes do not address these conditions and constraints on air and vapor flow throughout a wall. Therefore a new wall design and trim accessories are necessary to accommodate the different forms and function of the building envelope and prevent premature deterioration of the walls.

SUMMARY OF THE INVENTION

According to one aspect of the invention, a ventilation screed is provided comprising: an upper attachment flange having a top portion and a bottom portion and at least one opening in the top portion; a drip edge protruding from the bottom portion of the upper attachment flange and a return leg that protrudes back from the drip edge and extends beyond the bottom portion of the upper attachment flange; a drainage cavity protrusion protruding from the bottom portion of the upper attachment flange above the drip edge, wherein the drainage cavity protrusion has an L-shaped drainage trough portion having at least one drainage opening in a bottom portion and a substantially vertical portion with a top end and a bottom end in communication with the bottom portion, an upper ground portion in communication with the top end of the substantially vertical portion of the L-shaped drainage trough portion extending outward from the substantially vertical portion and a drainage cavity shroud extending substantially downward from the upper ground portion.

BRIEF DESCRIPTION OF THE DRAWINGS

In the following section, the present disclosure will be described with reference to exemplary embodiments illustrated in the figures, in which:

FIGS. 14 and 15 depict a joint connector installed between two adjacent ventilation screeds according to one aspect of the present invention.

DETAILED DESCRIPTION

Figure 1:
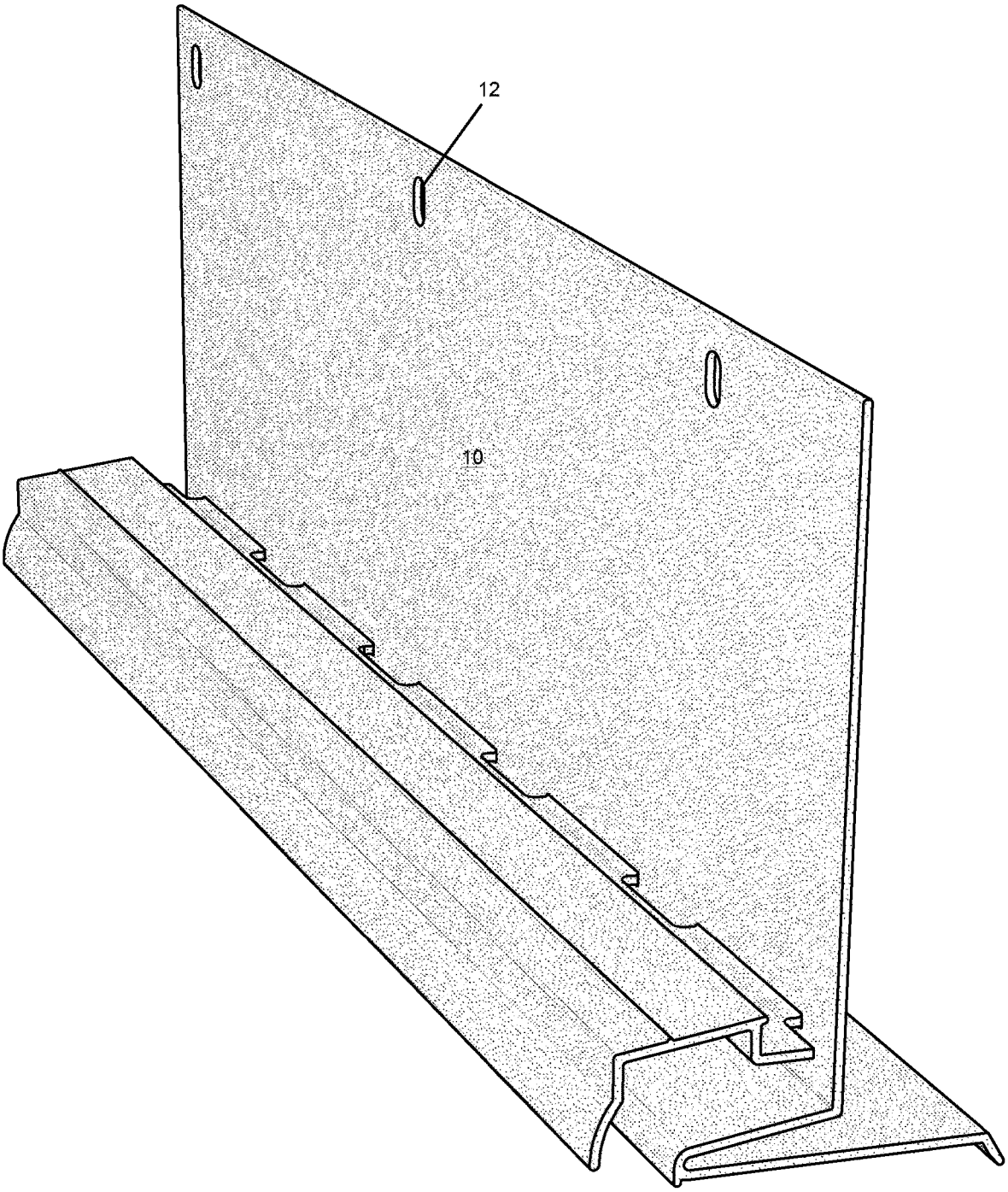
FIG. 1 is a top elevation view of the front of the extended drain screed according to the present invention.
Figure 2:
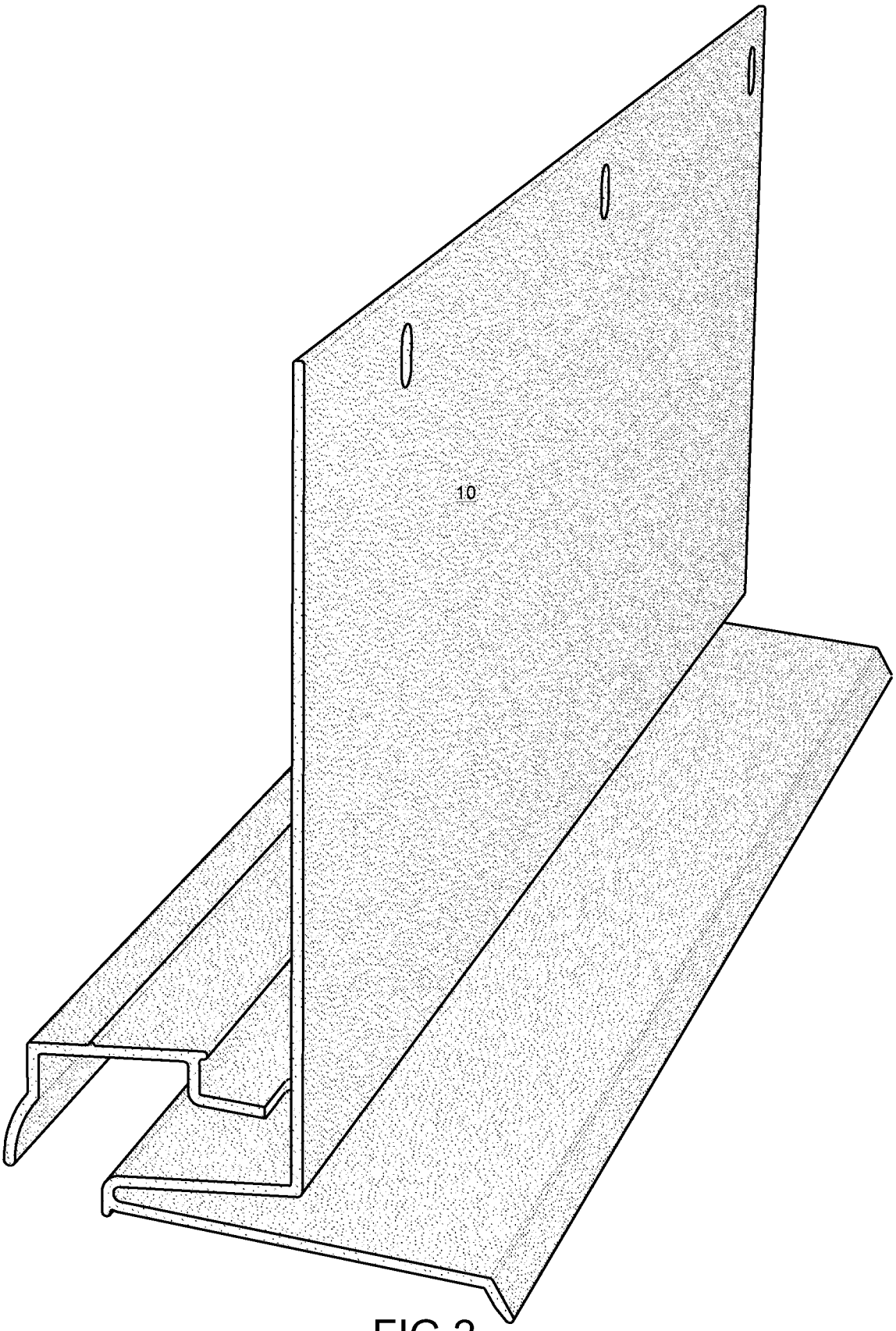
FIG. 2 is a top elevation view of the back of the extended drain screed according to the present invention.
Figure 3:
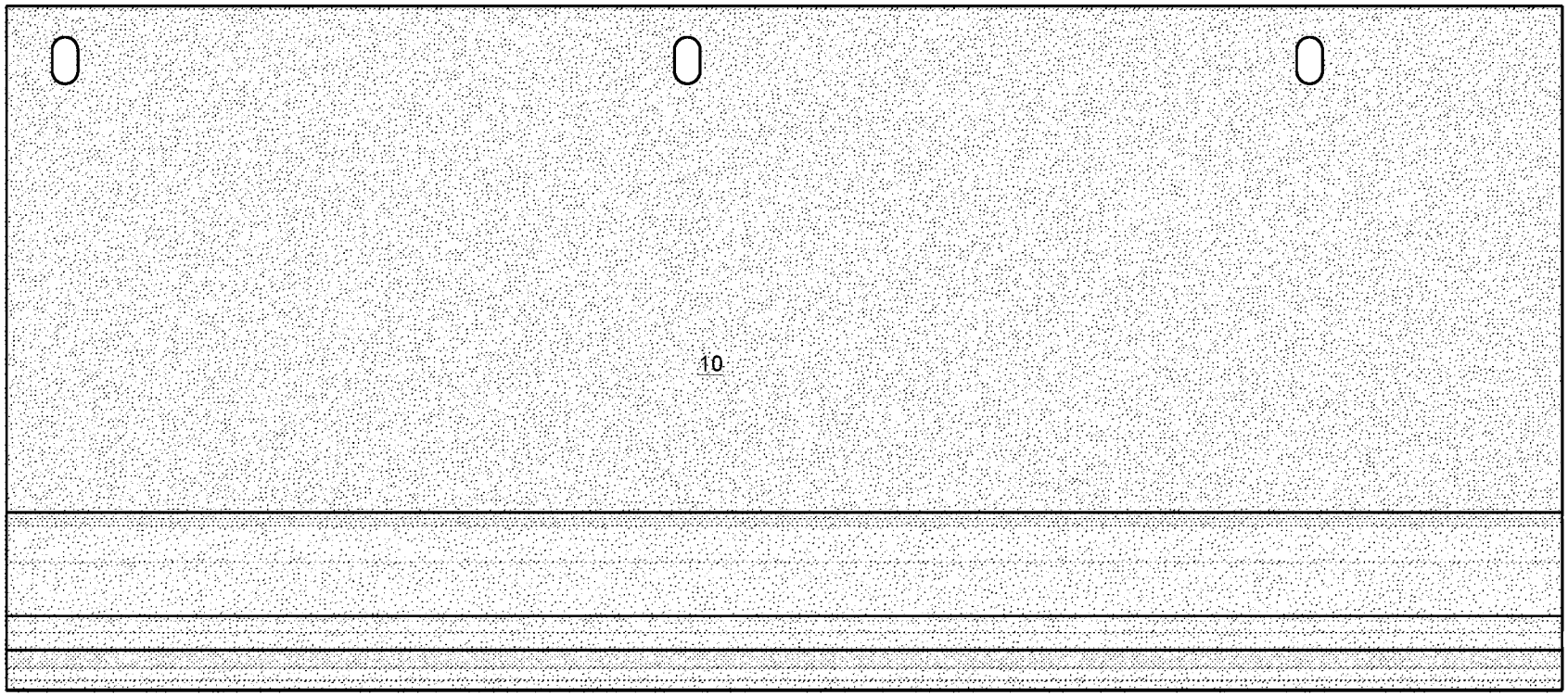
FIG. 3 is a front view of the extended drain screed according to the present invention.
Figure 4:
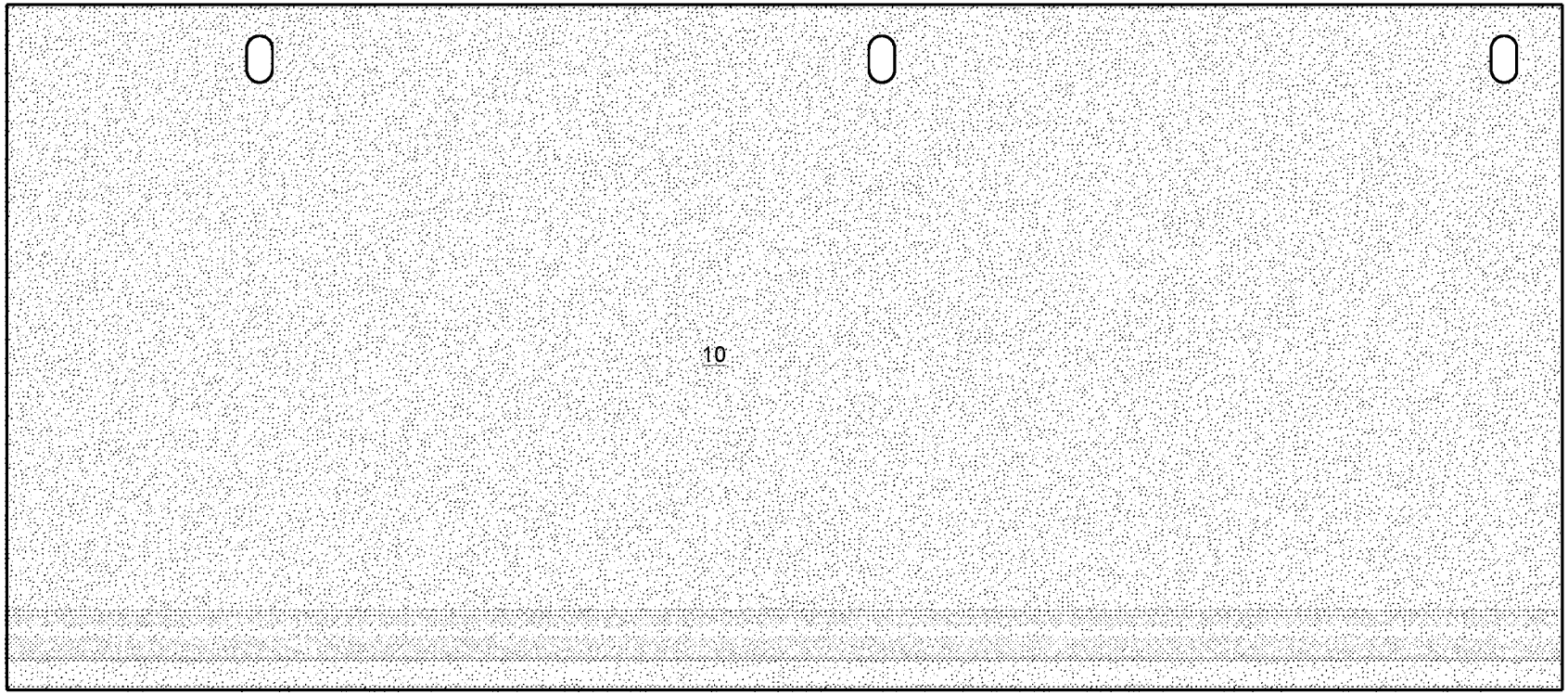
FIG. 4 is a back view of the extended drain screed according to the present invention.
Figure 5:
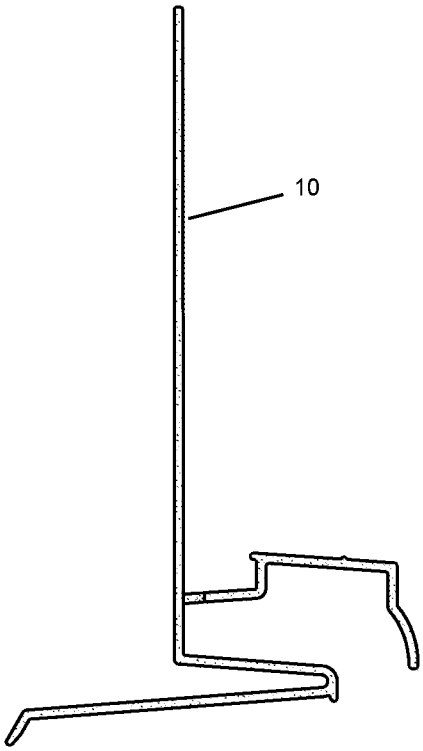
FIG. 5 is a side view of the extended drain screed according to the present invention.
Figure 6:
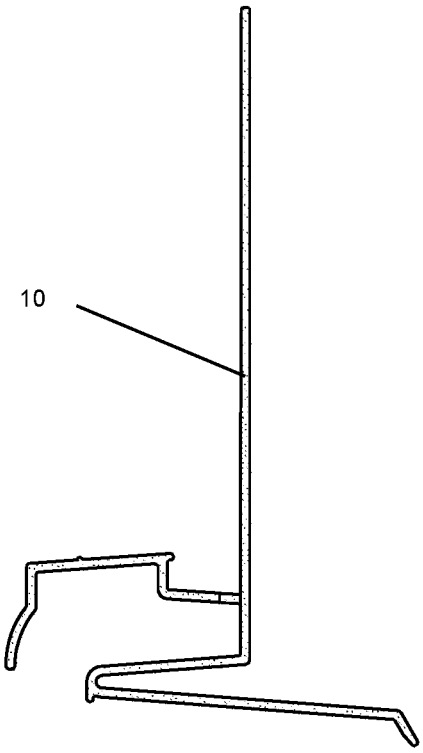
FIG. 6 is a side view of the extended drain screed according to the present invention.

In the following detailed description, numerous specific details are set forth in order to provide a thorough understanding of the disclosure. However, it will be understood by those skilled in the art that the present disclosure may be practiced without these specific details. In other instances, well-known methods, procedures, components and layouts have not been described in detail so as not to obscure the present disclosure.

Reference throughout this specification to "one embodiment" or "an embodiment" means that a particular feature, structure, or characteristic described in connection with the embodiment is included in at least one embodiment of the present disclosure. Thus, the appearances of the phrases "in one embodiment" or "in an embodiment" or "according to one embodiment" (or other phrases having similar import) in various places throughout this specification are not necessarily all referring to the same embodiment. Furthermore, the particular features, structures, or characteristics may be combined in any suitable manner in one or more embodiments. Also, depending on the context of discussion herein, a singular term may include its plural forms and a plural term may include its singular form. Similarly, a hyphenated term may be occasionally interchangeably used with its non-hyphenated version, and a capitalized entry may be interchangeably used with its non-capitalized version. Such occasional interchangeable uses shall not be considered inconsistent with each other. It is noted that various figures (including component diagrams) shown and discussed herein are for illustrative purpose only, and are not drawn to scale.

FIGS. 1-16 depict a ventilation screed (10) according to the present invention. The ventilation screed (10) comprising an upper attachment flange (4) having a top portion (6), a bottom portion (8), at least one opening (12) in the top portion (6); a drip edge (12) protruding from the bottom portion (8) of the upper attachment flange (4) and a return leg (14) that protrudes back from the drip edge (12) and extends beyond the bottom portion (8) of the upper attachment flange (4). The drip edge (12) may be angled downward in a direction away from the upper attachment flange (4). The drip edge (12) may also have a downward bend (16) with a friction bead (18). The return leg (14) having a first end (40), a middle portion (42) and a second end (44), wherein the first end (40) is in communication with a far end (46) of the drip edge (12). The far end (46) of the drop edge (12) may include the downward bend (16). The second end (44) may also have a downward bend (50). The return leg (14) may slope downwardly from the first end (40) to the second end (44).

Figure 7:
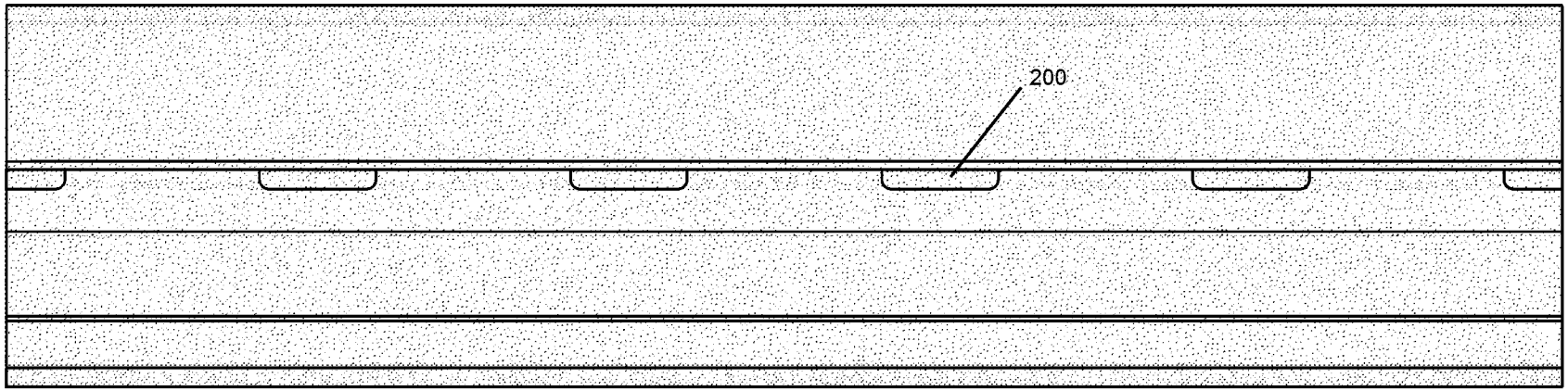
FIG. 7 is a top view of the extended drain screed according to the present invention.
Figure 8:
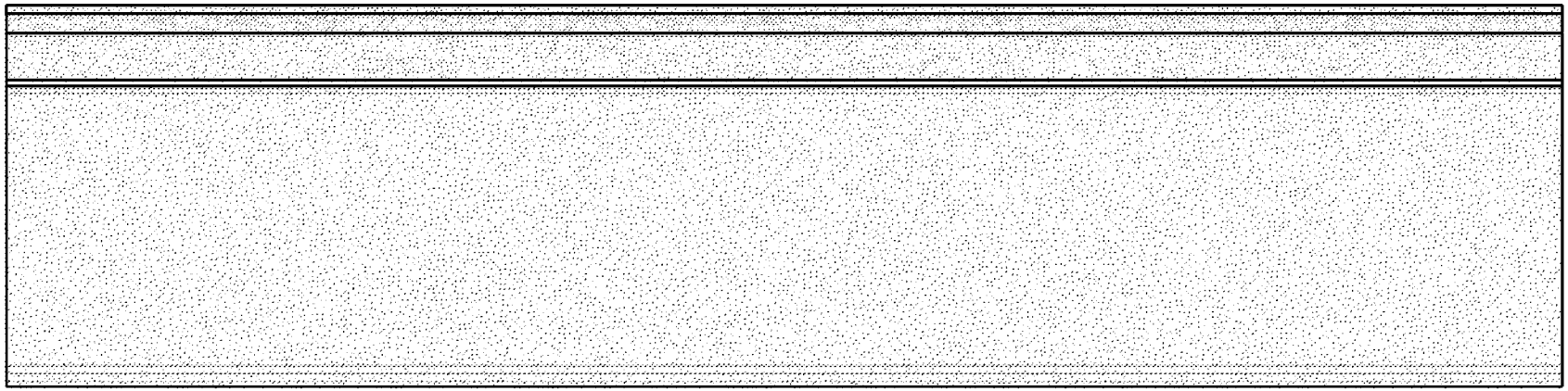
FIG. 8 is a bottom view of the extended drain screed according to the present invention.
Figure 9:
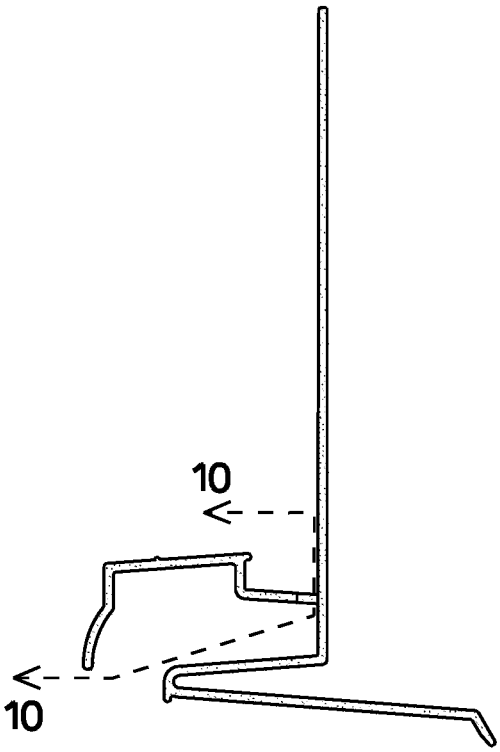
FIG. 9 is a side view of the extended drain screed with a dotted cutaway depicting the cutaway of FIG. 10 according to the present invention.
Figure 10:
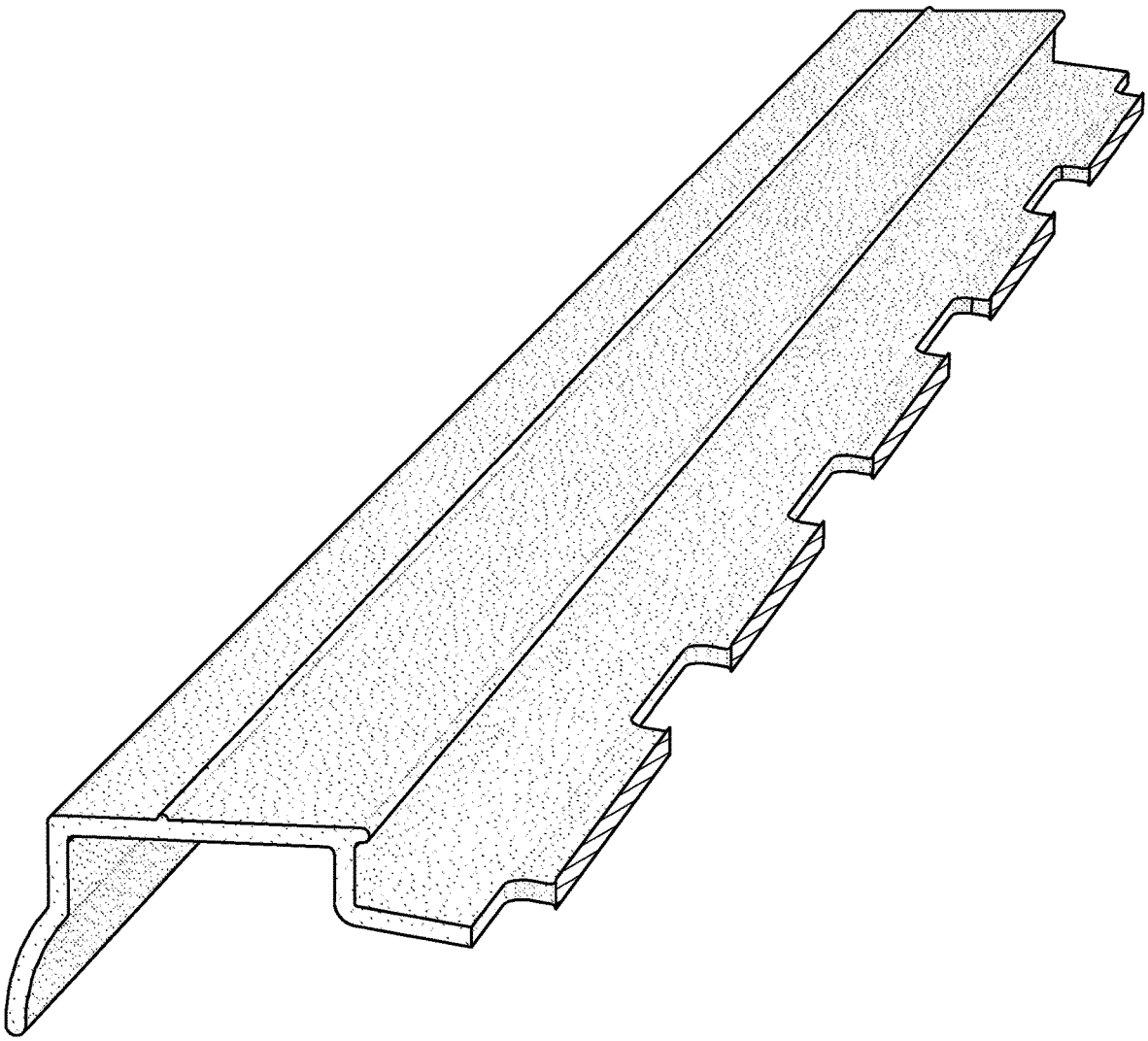
FIG. 10 is an elevation view of the cutaway shown at FIG. 9 according to the present invention.
Figure 11:
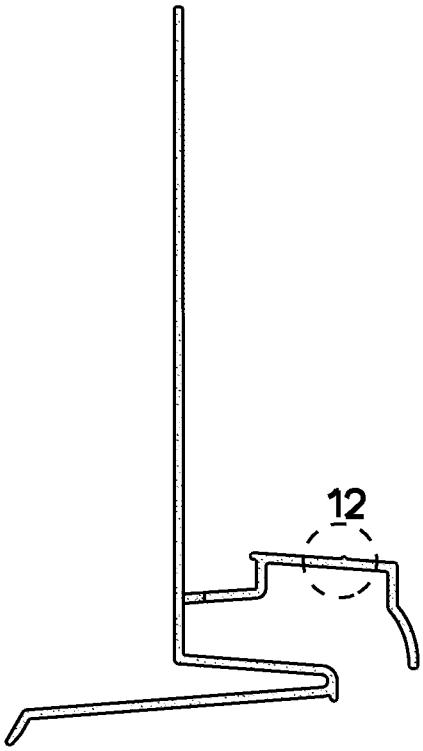
FIG. 11 depicts a detailed depicted in FIG. 12 according to the present invention.

There is a drainage cavity protrusion (22) protruding from the bottom portion (8) of the upper attachment flange (4) above the drip edge (12). It should be understood that the bottom portion (8) refers to approximately the bottom half of the upper attachment flange (4) and the upper portion would refer to the top half of the upper attachment flange (4). The drainage cavity protrusion (22) has an L-shaped drainage trough portion (24) having at least one drainage opening (28) in a bottom portion (30) and a substantially vertical portion (32) with a top end (34) and a bottom end (36) in communication with the bottom portion (30). The bottom portion (30) of the L-shaped drainage trough portion (24) may slope downwardly towards the bottom portion (8) of the upper attachment flange (4). The drainage openings (28) may be located where the drainage cavity protrusion meets the upper attachment flange. In this way, the water may be directed into the drainage openings (28). FIGS. 1 and 7 provide good vies of the drainage openings according to one example. There is an upper ground portion (20) in communication with the top end (34) of the substantially vertical portion (32) of the L-shaped drainage trough portion (24) extending outward from the substantially vertical portion (32) and a drainage cavity shroud (38) extending substantially downward from the upper ground portion (20). The drainage cavity shroud (38) may extend past the drip edge. The upper ground portion (20) may be substantially perpendicular to the substantially vertical portion (32) of the L-shaped drainage trough portion (24).

Figure 12:
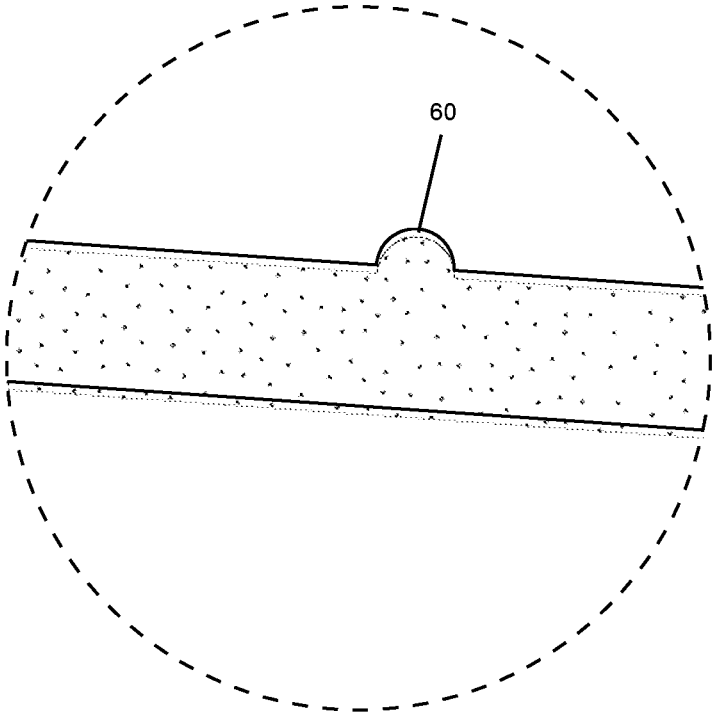
FIG. 12 is a close up of the detail provided in FIG. 11 according to the present invention.

The friction beads (e.g. 18, 26 and 60) are an important aspect of the present invention. There may be at least one rounded edge friction bead (e.g. 18, 26 and 60) along a portion of at least one of the upper attachment flange (4), the upper ground portion (20), the L-shaped drainage trough portion (24), the drip edge (12) and the drainage cavity protrusion (22). The friction bead is intended to reduce friction and direct the water in a smooth plane. The rounded friction bead is superior in reducing friction as it lacks edges. FIG. 12 depicts a rounded friction bead (60).

As depicted in FIGS. 14 and 15, there may be a joint connector (2200) between two adjacent ventilation screeds. As can be seen, when installed a left portion (2202) of the joint connector (2200) sits in a first ventilation screed (2204) and a right portion (2206) of the joint connector sits in a second ventilation screed (2208) and the second ventilation screed (2208) is adjacent to the first ventilation screed (2204). The joint connector ensures adjacent ventilation screeds are lined up properly. It is also provides easier and quicker installation. Once a first ventilation screed is attached and properly hung, an installed may work down the line with connectors quickly and easily. The joint connector may be shaped to correspond to the L-shaped drainage trough portion (24), the upper ground portion, at least a portion of the drainage cavity shroud (38) and the drip edge (12). In this way it may sit in the space formed by the L-shaped drainage trough portion (24), the upper ground portion, at least a portion of the drainage cavity shroud (38) and the drip edge (12). The connector should be slightly smaller than the space and may have openings that align with the drainage openings in a bottom portion of the L-shaped drainage trough portion (24).

Figure 13:
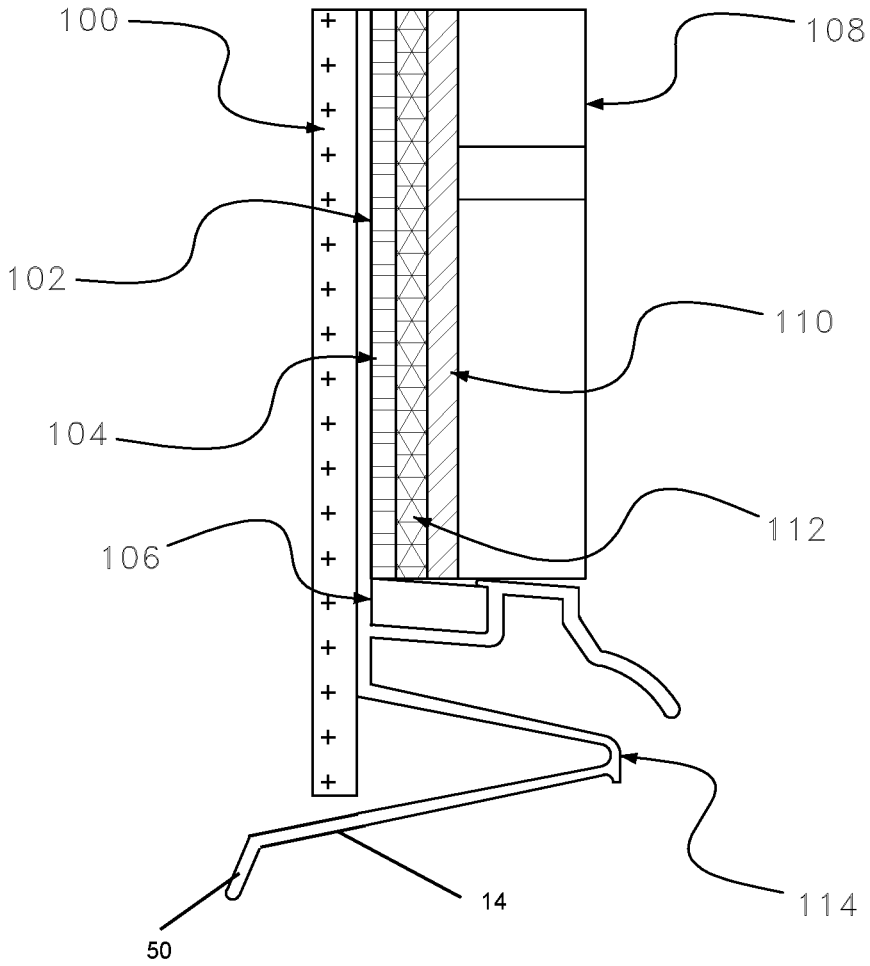
FIG. 13 depicts an example of the present invention installed.
Figure 16:
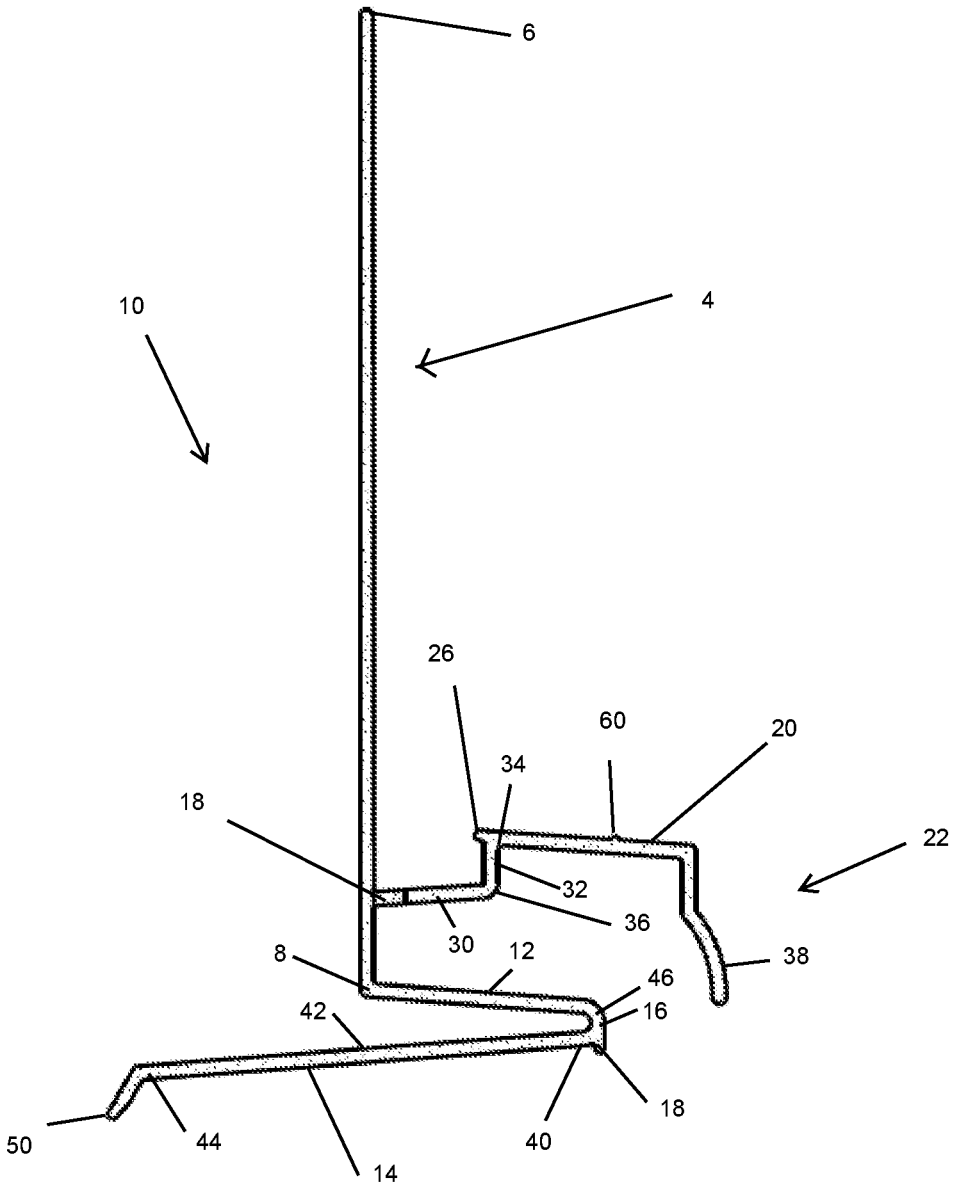
FIG. 16 depicts a labeled side view of the present invention.

FIG. 13 is intended to depict an example of an environment the present invention may be installed in. The building may have sheathing (100), with building wrap (102), grade D paper (104), there may be an insect screen (106) in the L-shaped drainage trough portion. The insect screen (106) could be reticulated foam, it could be an unwoven polymer such as cellulose, nylon or spun polypropylene fiber, or it could be even a nylon or polypropylene screen, although that would be less durable. There may be "Green Screen™", or another rain screen or solid or corrugated furring strips (112) to the right of the ventilation screed (114), then lath (110) and brick or stone veneer (108). The "Green Screen™", or another rain screen or solid or corrugated furring strips (112) may be installed parallel to and between siding and the upper attachment flange portion. There may also, or alternatively, be a mesh vertical and perpendicular to at least a portion of the upper attachment flange. There may also be reticulated foam (which may be in the same location as the rain screen or solid or corrugated furring strips (112)), then lath (110) and brick or stone veneer (108). The reticulated foam insert may be installed parallel to and between siding and the upper attachment flange portion. The term "greenscreen" refers to a polypropylene entangled mesh, but it could also be described as a polymer strand matrix with a dimple structure. The Greenscreen™ provides a drainage path and ventilation for moisture between the exterior wall finish and sheathing. It is a polymer strand matrix with a unique dimple design that exhibits superior compressive strength. When installed according to the present invention is allows over 99% of moisture and vapor to drain and escape from the wall. In the embodiment depicted, the return leg (14) extends back past and under a portion of the building (100). The return leg may also just extend under a portion of the building (100) and not back past a portion of the building. This directs moisture away from the building.

The present invention overcome the problems presented above and other problems relative to the escape of vapor and moisture from a wall, at locations below the top of the wall, as will be apparent to those skilled in the art of building cladding. As vapor is accumulated within a wall the flow of vapor can move by gravity or convection created by temperature, pressure or intrusion from outside the wall system. As temperature causes vapor to condense and move down the wall or pressure, moves the vapor to a lower pressure area, this invention allows the moisture and vapor to escape at the invention's provided wall outlets. The present invention have common design elements above the surface adjacent to the lower surface of the drainage cavity. According to one of the embodiments an attachment flange with openings for nailing or other attachment means is provided. According to another embodiment this invention incorporates a primary drainage plane that will be installed on top of the attachment flange to continue an unobstructed movement of vapor and moisture. According to the present invention a drainage trough is located at the base of the attachment flange. The drainage trough provides a location for the rainscreen to seat. The trough is perforated with drainage openings to continue the unobstructed movement of vapor and moisture. According to present invention the trough with slotted openings provides the transition to the drainage cavity where vapor and moisture then passes to the exterior of the wall. According to the present embodiment a longitudinal edge acts as a screed in determining and helping to maintain a consistent thickness of finish. According to the present invention a shaped lip extends beyond the screed edge acting as a shroud to help prevent wind or pressure driven water from entering the walls of the building or structure. By introducing a primary drainage plane, vapor can escape from above by following the rainscreen down the outer surface of the attachment flange, through drainage trough, entering the drainage cavity and escape the wall further allowing the wall to dry. Embodiments of this invention can be incorporated into new construction or the remediation of worn or deficient walls of stucco, manufactured stone or systems utilizing continuous rigid thermal insulation.

The substantially solid upper attachment flange with multiple attachment Openings is typically a planar surface that is attached to a vertical building wall. Attachment of the upper attachment flange is achieved with one of more nails, screws, other mechanical fasteners or adhesive. This upper attachment flange acts as a vapor barrier that can utilize rainscreen and or Water Resistant Barrier, WRB, positioned on top of this flange. Vapor can move through heat exchange or gravity. The present invention provides a moisture removal assembly including drainage trough with friction beads and drainage openings that allow for vapor to follow the primary drainage plane into the drainage cavity and vapor to exit the wall between the drainage cavity shroud and drip edge. The friction beads provide an optional rainscreen with a snug fit with in the drainage trough. A plurality of sized and shaped openings in the base of the drainage trough allow vapor to easily pass to the drainage cavity. The lower surface of the drainage cavity is sloped and ending with a drip Edge to facilitate the escape of vapor in whatever form may exist. The device according to the present invention can terminate stucco at the base of a full height wall, base of a step wall, a change in roofline where a vertical element terminates into a non-vertical structure such as a dormer and roof for the removal of vapor from the wall, the header of a window or door or any other through wall penetration.

A device according to the present invention can terminate stucco at the base of a full height wall, base of a step wall, a change in roofline where a vertical element terminates into a non-vertical structure such as a dormer and roof for the removal of vapor from the wall. The lower surface of the Drainage Cavity is sloped ending at a formed Drip Edge all facilitating the outward movement of vapor in any form that may exist. The ventilation screed according to the present invention can terminate one finish at any location in a wall and start the same or new finish as design or need for vapor removal is desired. This embodiment of the device permits wall ventilation and escape of moisture where there is a break in the finish materials such as transitioning from one finish to another such as from stucco to thin veneer stone or continuous rigid thermal insulation or at the floor breaks on multi-story buildings. FIGS. 14 and 15 depicts a "connector" accessory to facilitate the straight, true and continuous installation of various embodiments of this invention. An optional predefined drip edge can be incorporated. The lower surface of the drainage cavity forms this drip edge. The surface is sloped to facilitate the escape of vapor in whatever form that exists. The precise dimensions of the wall ventilation devices according to various embodiments of the present invention may vary from application to application as will be apparent to one of ordinary skill in the art.

As shown in FIG. 7, the drainage cavity protrusion has an L-shaped drainage trough portion having at least one drainage opening (200) in a bottom portion. In this embodiment the drainage opening is located where the drainage cavity protrusion meets the upper attachment flange and the opening may be shaped as a rectangle with rounded corners or a portion of a rectangle with rounded corners.

FIGS. 1, 2, 5, 6, 9, 11, 13 and 16 depict that the drip edge (18) is angled downward in a direction away from the upper attachment flange (4).

As the invention has been described, it will be apparent to those skilled in the art that the same may be varied in many ways without departing from the spirit and scope of the invention. Any and all such modifications are intended to be included within the scope of the appended claims.

In the preceding description, for purposes of explanation and not limitation, specific details are set forth (such as particular structures, components, techniques, etc.) in order to provide a thorough understanding of the disclosed fencing system. However, it will be apparent to those skilled in the art that the disclosed system may be constructed in other embodiments that depart from these specific details. That is, those skilled in the art will be able to devise various arrangements which, although not explicitly described or shown herein, embody the principles of the disclosed system. In some instances, detailed descriptions of well-known components and construction methods are omitted so as not to obscure the description of the disclosed system with unnecessary detail. All statements herein reciting principles, aspects, and embodiments of the disclosed system, as well as specific examples thereof, are intended to encompass both structural and functional equivalents thereof. Additionally, it is intended that such equivalents include both currently known equivalents as well as equivalents developed in the future, such as, for example, any elements developed that perform the same function, regardless of structure.

As will be recognized by those skilled in the art, the innovative concepts described in the present application can be modified and varied over a wide range of applications. Accordingly, the scope of patented subject matter should not be limited to any of the specific exemplary teachings discussed above, but is instead defined by the following claims.

We claim:

1. A ventilation screed comprising:

an upper attachment flange having a top portion and a bottom portion;

a drip edge protruding from the upper attachment flange and a return leg that protrudes back from the drip edge and extends beyond the bottom portion of the upper attachment flange;

a drainage cavity protrusion protruding from the upper attachment flange above the drip edge, wherein the drainage cavity protrusion has an L-shaped drainage trough portion having at least one drainage opening in a bottom portion and a substantially vertical portion with a top end and a bottom end in communication with the bottom portion, an upper ground portion in communication with the top end of the substantially vertical portion of the L-shaped drainage trough portion extending outward from the substantially vertical portion and a drainage cavity shroud extending substantially downward from the upper ground portion.

2. A ventilation screed as in claim 1, wherein the drip edge is angled downward in a direction away from the upper attachment flange.

3. A ventilation screed as in claim 1, wherein the drip edge has a downward bend.

4. A ventilation screed as in claim 1, further comprising at least one rounded edge friction bead along a portion of at least one of the upper attachment flange, the upper ground portion, the L-shaped drainage trough portion, the drip edge and the drainage cavity protrusion.

5. A ventilation screed as in claim 1, the return leg having a first end, a middle portion and a second end, wherein the first end is in communication with a far end of the drip edge.

6. A ventilation screed as in claim 5, wherein the second end has a downward bend.

7. A ventilation screed as in claim 5, wherein the return leg slopes downwardly from the first end to the second end.

8. A ventilation screed as in claim 1, further comprising a joint connector between two adjacent ventilation screeds.

9. A ventilation screed as in claim 1, further comprising a screen parallel to at least a portion of the upper attachment flange.

10. A ventilation screed as in claim 1, further comprising a mesh parallel to at least a portion of the upper attachment flange.

11. A ventilation screed as in claim 1, further comprising a reticulated foam insert that installed is parallel to and between siding and the upper attachment flange portion.

12. A ventilation screed as in claim 8, wherein a left portion of the joint connector sits in a first ventilation screed and a right portion of the joint connector sits in a second ventilation screed and the second ventilation screed is adjacent to the first ventilation screed.

13. A ventilation screed as in claim 1, further comprising an insect screen in the L-shaped drainage trough portion.

14. A ventilation screed as in claim 1, wherein the drainage opening is located where the drainage cavity protrusion meets the upper attachment flange.

15. A ventilation screed as in claim 1, wherein the upper ground portion is substantially perpendicular to the substantially vertical portion.

16. A ventilation screed as in claim 1, wherein the bottom portion of the L-shaped drainage trough portion slopes downwardly towards the bottom portion of the upper attachment flange.

17. A ventilation screed as in claim 1, wherein the drainage cavity shroud extends past the drip edge.

* * * * *